US011162489B2

(12) United States Patent
Huddleston

(10) Patent No.: US 11,162,489 B2
(45) Date of Patent: Nov. 2, 2021

(54) ELECTRO-MAGNETIC PUMP JACK

(71) Applicant: Kix Huddleston, Poteau, OK (US)

(72) Inventor: Kix Huddleston, Poteau, OK (US)

( * ) Notice: Subject to any disclaimer, the term of this patent is extended or adjusted under 35 U.S.C. 154(b) by 0 days.

(21) Appl. No.: 16/707,655

(22) Filed: Dec. 9, 2019

(65) Prior Publication Data

US 2020/0191135 A1 Jun. 18, 2020

Related U.S. Application Data

(60) Provisional application No. 62/781,076, filed on Dec. 18, 2018.

(51) Int. Cl.

| | |
|---|---|
| ***E21B 43/12*** | (2006.01) |
| ***F04D 13/06*** | (2006.01) |
| ***F04B 47/02*** | (2006.01) |

(52) U.S. Cl.

CPC ..... *F04B 47/026* (2013.01); *E21B 43/123* (2013.01); *E21B 43/1235* (2020.05); *E21B 43/13* (2020.05); *F04D 13/064* (2013.01)

(58) Field of Classification Search

CPC .. E21B 43/1235; E21B 43/123; E21B 43/127; E21B 43/13; F04D 13/064; F04B 47/026; F04B 7/0076

See application file for complete search history.

(56) References Cited

U.S. PATENT DOCUMENTS

| | | | | |
|---|---|---|---|---|
| 4,438,628 | A | 3/1984 | Creamer | |
| 4,687,054 | A | 8/1987 | Russell et al. | |
| 4,977,958 | A * | 12/1990 | Miller | E21B 34/12 166/205 |
| 5,409,356 | A | 4/1995 | Massie | |
| 6,368,075 | B1 * | 4/2002 | Fremerey | F04D 3/00 310/90.5 |
| 2007/0075545 | A1 | 4/2007 | Wilson et al. | |
| 2016/0105091 | A1 | 4/2016 | Wang et al. | |

* cited by examiner

*Primary Examiner* — Cathleen R Hutchins
(74) *Attorney, Agent, or Firm* — Boudwin Intellectual Property; Daniel Boudwin

(57) ABSTRACT

An electro-magnet pump jack including a base, a plurality of electro-magnetic coils, a cylinder, and a pump tube. The plurality of electro-magnetic coils is circular and stacked on top of one another. The coils are attached to a power source. The coils are configured to be turned on gradually moving up and down the stack creating a magnetic charge. The cylinder acts like a piston where the electro-magnets force the cylinder up and down. The cylinder has a guide tube that is secured through the middle of the pump jack. The cylinder is attached to a pump tube. The pump tube runs into the ground and controls the pump in the oil field.

10 Claims, 3 Drawing Sheets

ELECTRO-MAGNETIC PUMP JACK

CROSS REFERENCE TO RELATED APPLICATIONS

This application claims the benefit of U.S. Provisional Application No. 62/781,076 filed on Dec. 18, 2018. The above identified patent application is herein incorporated by reference in its entirety to provide continuity of disclosure.

BACKGROUND OF THE INVENTION

The present invention relates to oil field pump jacks. More particularly, the present invention provides and eco-friendly electro-magnetic pump jack. The pump jack uses electro-magnets to operate the pump jack.

The oil and gas industry is a huge international industry. While things like electric power are slowly making their way onto the scene, oil has shown no signs of slowing down. The field is constantly looking for new ways to improve upon how the oil is extracted from the ground. With the constant uproar about protecting the environment, many of these ways are moving toward environmentally safe alternatives.

One of the current ways oil is extracted is through use of a pump jack. The traditional pump jack is a large machine. This jack can take up massive amounts of space and can be very costly to install. The traditional pump jack requires a concrete pad containing at least 40 cubic feet of concrete. The large metal pump jack is controlled by a massive generator that moves a crank shaft. The crank shaft is connected to the rear of the pump jack and moves the jack up and down. This operates the pump tube and forces the oil out of the ground. These traditional jacks require a massive amount of resources to operate the crank shaft in order to move the pump jack.

Consequently, there is a need in for an improvement in the art of pump jacks. The present invention substantially diverges in design elements from the known art while at the same time solves a problem many people face when removing oil from deep below the Earth's surface. In this regard the present invention substantially fulfills these needs.

SUMMARY OF THE INVENTION

The present invention provides an electro-magnetic pump jack wherein the same can be utilized for providing a compact and energy efficient way to pump oil out of wells that are deep in the ground. The present system comprises a base having a hole located therethrough. A pump tube passing through the hole in the in the base, wherein the pump tube is connected to a cylinder. The cylinder is configured to have a magnetic pull. The cylinder has a hole located therein, wherein the hole is configured to have a vertical guide rod placed therethrough. The vertical guide rod is connected at a top end to an electro-magnet support, wherein the electro-magnet support is attached to the base. The electro-magnet support has a plurality of electro-magnetic coils placed vertically around the cylinder.

Another object of the present invention is to provide an electro-magnet pump jack, comprising a base having a hole located therethrough. A pump tube passing through the hole in the in the base, wherein the pump tube is connected to a cylinder. The cylinder is configured to have a magnetic pull. The cylinder has a hole located therein, wherein the hole is configured to have a vertical guide rod placed therethrough. The vertical guide rod is connected at a top end to an electro-magnet support, wherein the electro-magnet support is attached to the base. The electro-magnet support has a plurality of electro-magnetic coils placed vertically around the cylinder. A controller is attached to the plurality of electro-magnetic coils. The controller activates the coils moving up and down the plurality of coils in order to force the cylinder up and down.

Other objects, features and advantages of the present invention will become apparent from the following detailed description taken in conjunction with the accompanying drawings.

BRIEF DESCRIPTION OF THE DRAWINGS

Although the characteristic features of this invention will be particularly pointed out in the claims, the invention itself and manner in which it may be made and used may be better understood after a review of the following description, taken in connection with the accompanying drawings wherein like numeral annotations are provided throughout.

DETAILED DESCRIPTION OF THE INVENTION

Figure 1:
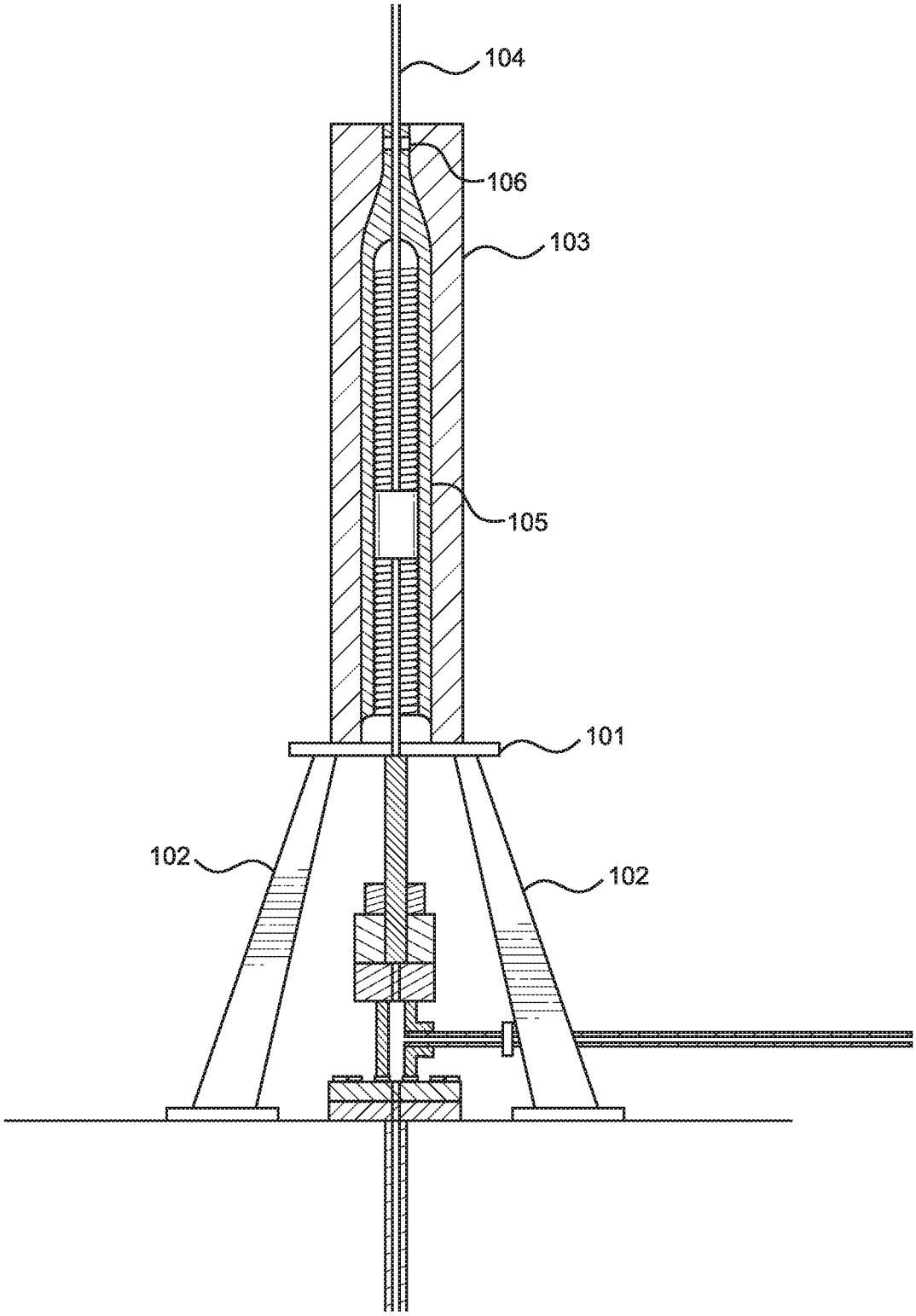
FIG. 1 shows a cross sectional view of an embodiment of the electro-magnetic pump jack.

Reference is made herein to the attached drawings. Like reference numerals are used throughout the drawings to depict like or similar elements of the electro-magnetic pump jack. For the purposes of presenting a brief and clear description of the present invention, a preferred embodiment will be discussed as used for removing oil from the wells in a cost effective and environmentally friendly matter. The figures are intended for representative purposes only and should not be considered to be limiting in any respect.

Referring now to FIG. 1, there is shown a cross sectional view of an embodiment of the electro-magnetic pump jack. The electro-magnetic pump jack has a base 101 that is supported buy a plurality of leg supports 102. In one embodiment, the plurality of leg supports 102 form a tripod stand. In another embodiment, the plurality of leg supports 102 has four or more legs. The plurality of leg supports 102 keep the base 101 up off the ground. This will allow for the well hole to be under the electro-magnetic pump jack, such that the electro-magnetic pump jack is in the correct position to pump oil from an oil well. Using the plurality of leg supports 102 to place the electro-magnetic pump jack directly over the well, a user can place the electro-magnetic pump jack such that the electro-magnetic pump jack takes up a significantly smaller area that the traditional pump jack.

The electro-magnetic pump jack has multiple components attached to the top surface of the base 101. There is a cover 103 for the electro-magnetic pump jack. The cover 103 is attached to the base 101 and rises above the base. The cover 103 is of a size that will cover all of the internal parts of the electro-magnetic pump jack. In one embodiment the cover has an internal chamber 105. The internal chamber 105 is cylindrical and tapers inward at a top end thereof. This tapering will allow the internal chamber 105 to be closer to the vertical guide rod 104. In one embodiment, the cover 103 is made from plastic. In one embodiment, the cover 103 is made from fiberglass. In another embodiment, the cover 103 is made from metal or any other suitable material.

The internal parts of the electro-magnetic pump jack include a vertical guide rod 104. The vertical guide rod 104 is attached to the top of the electro-magnetic pump jack. The vertical guide rod 104 does not connect to the base of the electro-magnetic pump jack. In one embodiment, the guide rod 104 is attached to the cover 103. In one embodiment the guide rod 104 is attached to the internal chamber 105. In an embodiment the guide rod 104 is attached via a clamp 106. In another embodiment, there is a support structure attached to the base. The internal chamber 105 can act as support structure and starts at the base and comes to a point at the top of the electro-magnetic pump jack. The support structure will hold the vertical guide rod 104 in a vertical position above the oil well.

Figure 2:
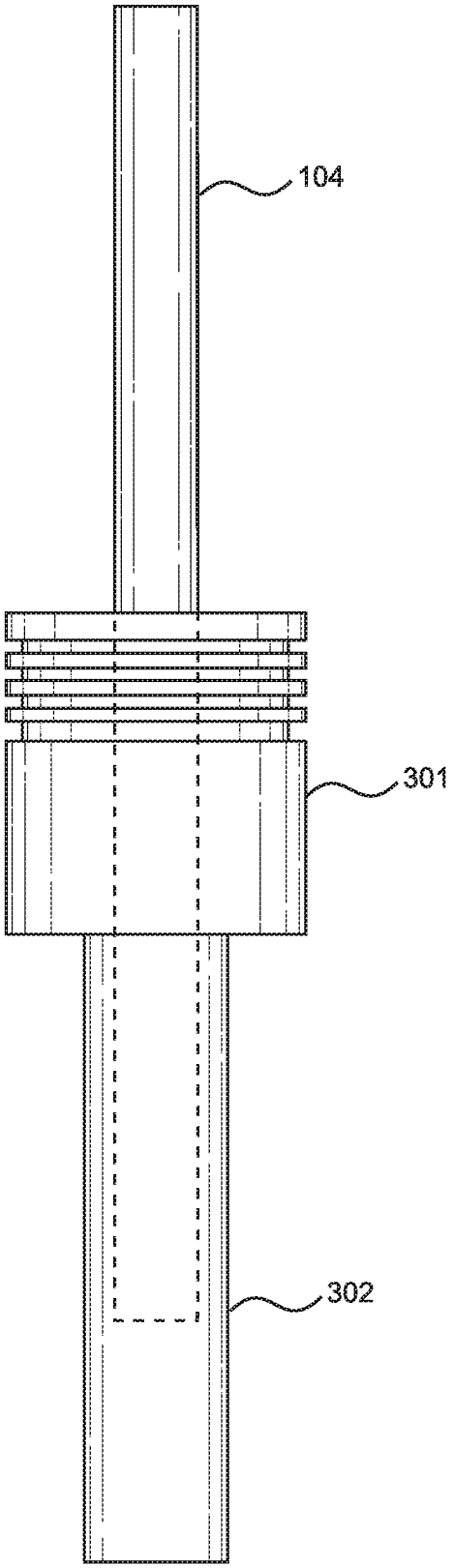
FIG. 2 shows a perspective view of an embodiment of the magnetic cylinder for the electro-magnetic pump jack.

Referring now to FIG. 2, there is shown a perspective view of an embodiment of the magnetic cylinder for the electro-magnetic pump jack. There is a cylinder 301 located in the electro-magnetic pump jack. The cylinder 301 further comprises a hole located therethrough. The hole will accept the vertical guide rod 104 therein. The cylinder 301 further comprises a material having a magnetic property. This will allow the cylinder 301 to be moved up and down by the electro-magnetic coils. The cylinder 301 will be forced up and down by the electro-magnetic coils.

The cylinder 301 has a pump tube 302 attached to a bottom section of the cylinder 301. The pump tube 302 is configured to be fitted to the cylinder 301 and to also have the guide rod 104 placed therein. The guide rod 104 allows the cylinder 301 to slide up and down while staying in the proper alignment. The pump tub 302 is attached to the lower side of the cylinder 301. This will allow the cylinder 301 to move the pump tube 302 up and down while being guided by the vertical guide rod 104. The pump tube 302 will exit through the bottom of the base and connect to the pump. The pump tube 302 will actuate the pump and pump oil from the well.

In operation, the electro-magnetic pump jack is activated. The controller is set to activate the electro-magnetic coils at the correct interval. As the electro-magnetic coils are activated the cylinder is forced up the guide rod then back down in a steady repetitive pace. The cylinder moves the pump tube as the cylinder is forced up and down. This activates the pump mechanism and forces oil from the well.

Figure 3:
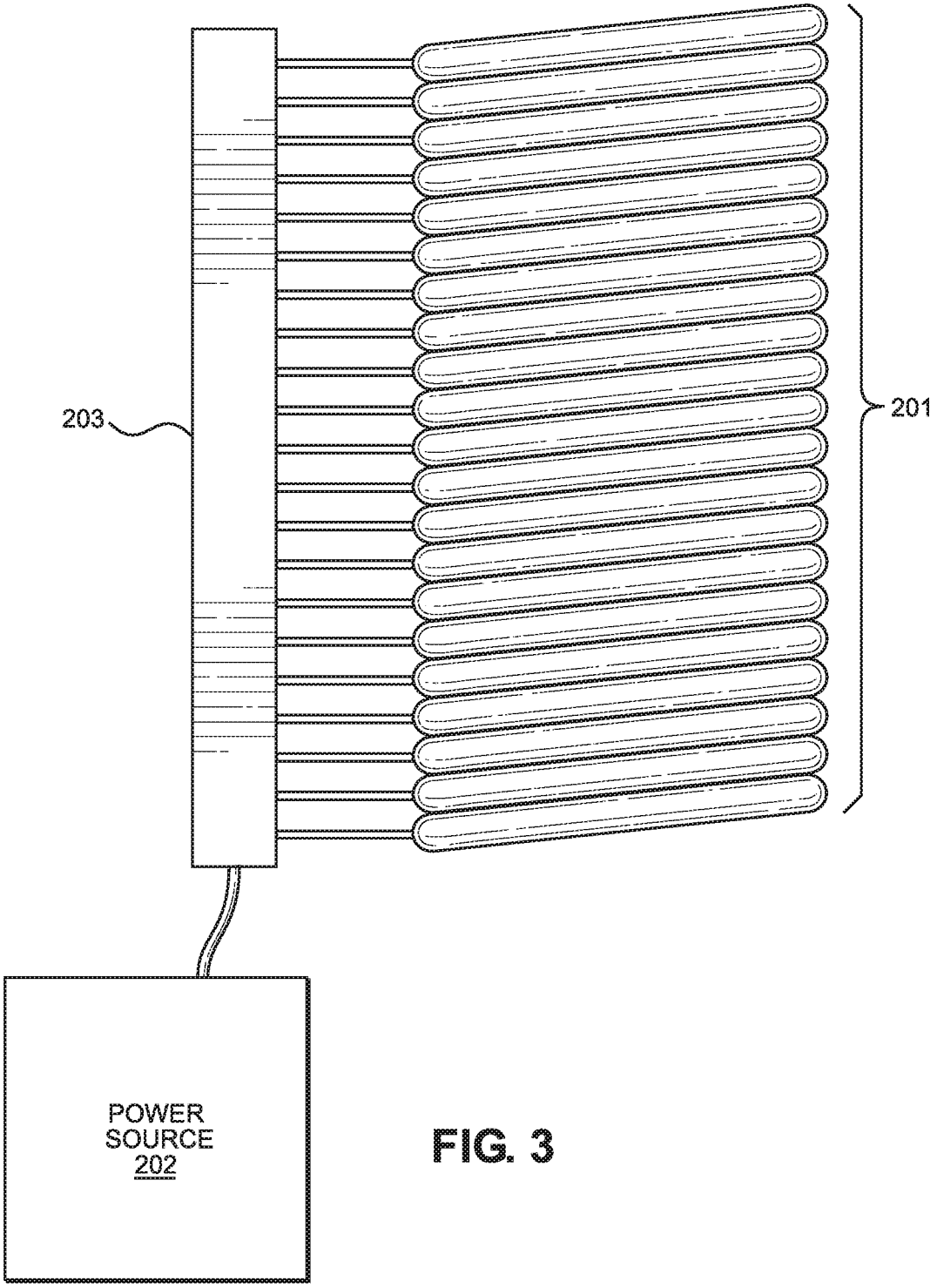
FIG. 3 shows a perspective view of an embodiment of the electro-magnet coils for the electro-magnetic pump jack.

Referring now to FIG. 3, there is shown a perspective view of an embodiment of the electro-magnet coils for the electro-magnetic pump jack. The electro-magnetic pump jack further includes a plurality of electro-magnetic coils 201 disposed about the interior of the pump jack column. In one embodiment, the electro-magnetic coils 201 are made from copper. The electro-magnetic coils 201 are placed one on top of the other forming a vertical tube. In one embodiment, the electro-magnetic coil tube is made from a single layer of coils. In another embodiment, the electro-magnetic coil tube is made from a double layer of coils. This disclosure is not limiting to the size or power of the electro-magnetic coils 201. The electro-magnetic coils 201 are configured to be powerful enough to operate the electro-magnetic pump jack.

The electro-magnetic coils are connected to a power source 202. The power source 202 will power the magnetic properties of the electro-magnetic coils 201. In one embodiment, the power source 202 is a generator. In one embodiment, the power source 202 is from a centralized power station. In another embodiment, the power source 202 is a solar power source. In yet another embodiment, the power source 202 is a combination of power sources. The power source 202 is capable of being placed within the electro-magnetic pump jack cover. In another embodiment, the power source 202 is a separate unit.

In one embodiment the electro-magnetic coils are operably coupled to a controller 203. The controller 203 directs power to the electro-magnetic coils 201. The controller 203 can be configured to move the current up and down the electro-magnetic coils 201 to move the magnetic pull or push up and down the electro-magnetic pump jack. The controller provides power sequentially to each coil of the plurality of coils, such that a magnetic force is generated progressively along the pump column, thereby moving the magnetic cylinder. This will operate the pump.

It is therefore submitted that the instant invention has been shown and described in what is considered to be the most practical and preferred embodiments. It is recognized, however, that departures may be made within the scope of the invention and that obvious modifications will occur to a person skilled in the art. With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. An electro-magnet pump jack, comprising:

a base having a hole located therethrough;

a plurality of leg supports;

a pump tube passing through the hole in the in the base connecting to an oil pump; the pump tube is affixed to the bottom of a cylinder;

wherein the cylinder is configured to have magnetic properties;

wherein the cylinder having a hole located therein;

wherein the hole is configured to have a vertical guide rod placed therethrough;

wherein the vertical guide rod is connected at a top end to an electro-magnet support, wherein the electro-magnet support is attached to the base;

wherein the electro-magnet support has a plurality of electro-magnetic coils; and a controller operably attached to the plurality of electro-magnetic coils.

2. The electro-magnet pump jack of claim 1, further comprising a power source operably coupled to the electro-magnetic coils.

3. The electro-magnet pump jack of claim 1, wherein the plurality of electro-magnetic coils are disposed on top of each other forming a vertical tube.

4. The electro-magnet pump jack of claim 1, wherein the plurality of electro-magnetic coils are placed vertically around the cylinder.

5. The electro-magnet pump jack of claim 1, wherein the controller activates the plurality of coils to move the cylinder up and down the guide rod, whereby the pump tube moves up and down in accordance with the cylinder.

6. The electro-magnet pump jack of claim 5, whereby the movement of the pump tube will activate the oil pump and extract the oil.

7. The electro-magnet pump jack of claim 6, wherein the cover includes an internal chamber, whereby the internal chamber is cylindrical and tapers inward at the top end to allow the internal chamber to be closer to the vertical guide rod.

8. The electro-magnet pump jack of claim 6, wherein the housing is plastic.

9. The electro-magnet pump jack of claim 6, wherein the housing is fiberglass.

10. The electro-magnet pump jack of claim 1, further comprising a cover, wherein the cover protects the electro-magnetic coils.

* * * * *